United States Patent [19]

Libit

[11] 4,341,320

[45] Jul. 27, 1982

[54] TAMPERING INDICATING BOTTLE CAP AND BOTTLE

[76] Inventor: Sidney M. Libit, 441 Lake Side Ter., Glencoe, Ill. 60022

[21] Appl. No.: 193,810

[22] Filed: Oct. 3, 1980

[51] Int. Cl.[3] ..... B65D 41/28

[52] U.S. Cl. ..... 215/341; 215/354

[58] Field of Search ..... 215/341, 344, 354, 320, 215/270, 271

[56] References Cited

U.S. PATENT DOCUMENTS

| | | | |
|---|---|---|---|
| 1,162,519 | 11/1915 | Schuster | 215/354 X |
| 2,034,739 | 3/1936 | Bodor | 215/271 X |
| 2,914,206 | 11/1959 | Lowen | 215/320 |
| 3,057,501 | 10/1962 | Kroenert | 215/354 X |
| 3,275,178 | 9/1966 | Lovell et al. | 215/354 X |
| 3,281,000 | 10/1966 | Lowen | 215/344 |
| 4,206,852 | 6/1980 | Dunn et al. | 215/354 X |

FOREIGN PATENT DOCUMENTS

| | | | |
|---|---|---|---|
| 1159427 | 2/1958 | France | 215/354 |
| 2001039 | 1/1979 | United Kingdom | 215/344 |

*Primary Examiner*—Donald F. Norton

*Attorney, Agent, or Firm*—Hill, Van Santen, Steadman, Chiara & Simpson

[57] ABSTRACT

A bottle cap having an outer peripheral skirt for receipt around the neck of a bottle with an axial end overlying the throat opening of the bottle, the axial end having a first annular flat land adjacent the outer periphery and a central land raised above the flat land and connected to a flat land by an annular convoluted portion adapted to be received interiorly of the throat opening. The convoluted portion is deformable such that the central land can be depressed to a point approximately coextensive with the top surface of the annular flat land. During depression the convoluted portion snuggly engages the inside diameter wall of the bottle neck. The convoluted portion is dimensioned such that when the cap is placed on the bottle and urged downwardly with respect to the bottle top, the central land will assume a position elevated above the annular flat land.

6 Claims, 5 Drawing Figures

FIG 1
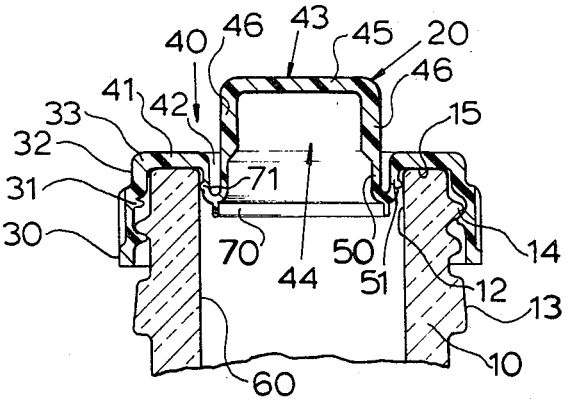
FIG 2
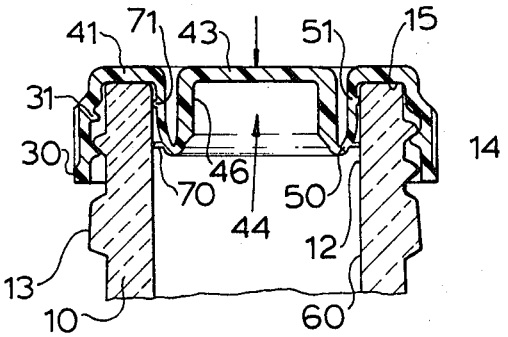
FIG 3
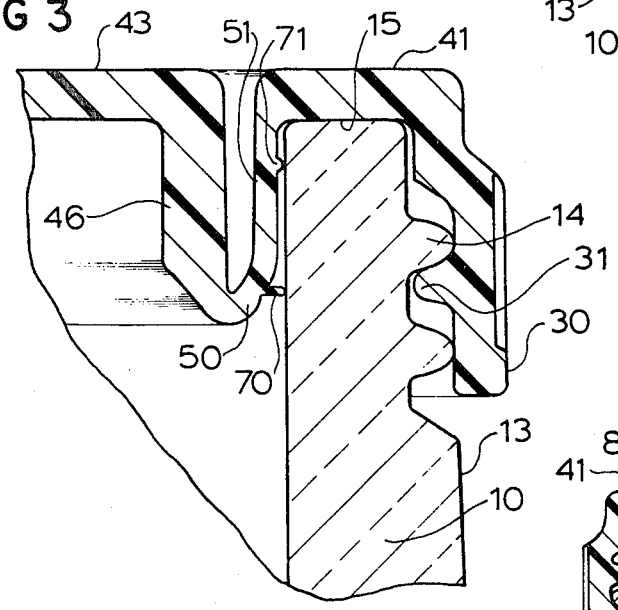
FIG 4
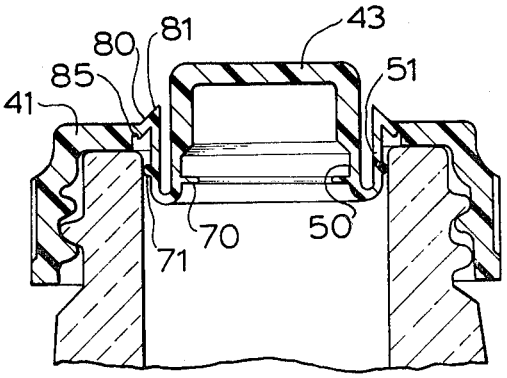
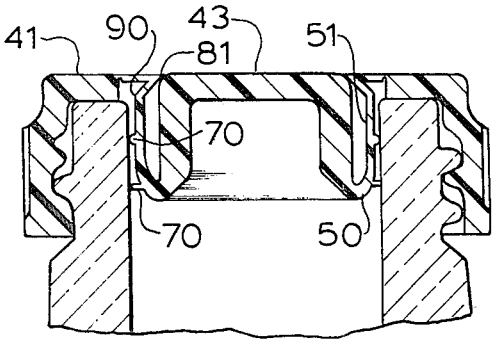
FIG 5

TAMPERING INDICATING BOTTLE CAP AND BOTTLE

BACKGROUND OF THE INVENTION

1. Field of the Invention

This invention relates to container closures and, more particularly, to a plastic bottle cap.

2. Description of the Prior Art

Bottle caps, particularly bottle caps for consumable beverages, must have certain identifiable features. These are durability, inexpensiveness, ability to retain pressure, particularly where the beverage is carbonated, and a tamper-proof feature. In order to provide such inexpensive caps with tamper-proof features, it has been a known practice to utilize caps having integral tear strips which must be removed to allow the cap to be removed from the bottle neck. It is also known to have portions depending from the skirt which can be deformed over an outer rib on the bottle neck such that the portion must be either broken away from the skirt, or, in metal tops, circumferentially serrated upon removal of the cap.

Certain disadvantages have arisen in the use of such caps. In those instances utilizing plastic caps having portions depending from the skirt which are adapted to be separated from the skirt upon removal of the cap, there are both disadvantages in requiring an extra step to constrict the portion around the bottle rib after the cap is threaded onto the bottle and, in some instances, particularly with the elderly, the strength necessary to cause separation may be so great as to become a disadvantage. Further, in connection with metal caps, the strength necessary to cause the opening of the circumferentially spaced serrations may also be disadvantageous for certain people, particularly the elderly, and in other instances, can be so great as to strip the threads of the metal cap prior to the serrations being opened. Additionally, the plastic strip remaining on the bottle is unsightly and, when using metal tops, the resultant serrated metal edge can be a source of injury.

It has been suggested to provide a plastic bottle cap having an outer skirt for engaging the outer wall of the bottle neck and an inner skirt for engaging the inner wall of the bottle neck. In such a construction, as shown in U.S. Pat. No. 4,206,852, the bottle cap consists of an outer skirt, an axial end wall having a peripheral portion adjacent the outer skirt, the peripheral portion terminating in a first inner depending skirt extending downwardly substantially parallel with the outer skirt, a second inner skirt extending upwardly and a connecting portion connecting the two inner skirts. A central disc shaped land is formed inwardly of the second inner skirt. In such a construction the central land is not movable with respect to the peripheral land of the axial end.

It would therefore be an advance in the art to provide a bottle cap having an anti-tamper feature which allows easy recognition of a previously opened bottle, which cap also has advantages of strength, economics of production and ability to retain a seal under pressure.

SUMMARY OF THE INVENTION

The bottle cap of this invention, preferably made of plastic, is circular and has three distinct radially spaced sections. The outermost section comprises a depending skirt for engagement with the outer peripheral surface of the bottle neck. At the top of the depending skirt is an annular flat land forming an axial end wall portion adapted to overlye the ring neck end of the bottle. Radially inwardly of the annular flat land is a substantially U-shaped cross section convoluted connecting portion which connects the annular flat land to a central land forming the central portion of the cap.

The annular convoluted portion is flexible such that the relative length of the two legs of the U-shaped cross section can be changed. In its relaxed state the cap has the central land rising above the top of the annular flat land. Due to the flexibility of the convoluted portion, the central land can be pressed downwardly so that its top surface become substantially coplaner with the top of the annular flat land. This downward movement is accommodated by changing the respective lengths of the legs of the U-shaped cross section annular convoluted portion.

The radially outermost leg of the convoluted portion is adapted to engage the inner diameter of the throat of the bottle.

After the skirt has been assembled onto the bottle, either by threading, or by pushing on, the radially outermost leg of the convoluted portion will engage the inner wall of the throat opening of the bottle neck. A seal may be provided around the outer surface of the radially outermost leg to assure sealing contact. Thereafter the central land may be depressed. As a result of depression, the convoluted portion will more snugly engage the inner diameter wall of the throat. An additional seal may be provided on the convoluted portion which will come into engagement with the inner diameter wall of the throat opening upon depressing the cental land.

The bottle cap of this invention has a stable position with the central land fully depressed, and tests have shown that this position will remain stable even if the bottle is subjected to considerable internal pressure.

Upon removal of the bottle cap from the bottle, any attempt to reassemble the bottle cap will cause the convoluted portion to engage the axial end of the bottle neck. Further, attempted closure of the bottle with the cap will cause the central land to revert to its raised position. Because a quantum of force is required to depress the central land, the resultant raised central land provides a tamper-proof indicator.

Thus, when applying the bottle cap, at the point of manufacture, the central land is depressed. Any prospective purchaser seeing a bottle closed with this cap having a raised central land will immediately know that the bottle has been previously tampered with.

In the first embodiment illustrated, the convoluted portion produces an axial groove surrounding the central land between the central land and the annular flat land. In a second embodiment, a hinged upwardly extending substantially frustoconical lip portion is provided intermediate the annular flat land and the radially outermost leg of the convoluted portion. Upon depressing the central land, this lip will pivot around the hinge to close the groove between the central land and the annular flat land thereby presenting a substantially smooth surfaced cap top.

It is therefore an object of this invention to provide an improved plastic closure cap having tamper detection means.

It is another, and more specific, object of this invention to provide a plastic closure cap having a central portion axially movable from a position elevated above surrounding areas to a position approximately planer with surrounding portions.

It is another, and more specific, object of this invention to provide a plastic closure cap having an outer peripheral skirt and an axial end wall forming a cup shaped cap with the axial end wall formed of a first radially inwardly extending flat land, a convoluted land and a central land with the convoluted land joining the annular flat land to the central land and allowing the central land to move axially with respect to the flat land.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a fragmentary enlarged sectional view of a bottle neck provided with the closure cap of this invention illustrating the central land in its raised position.

FIG. 2 is a view similar to FIG. 1 illustrating the central land in its depressed position.

FIG. 3 is an enlarged fragmentary sectional view of portions of FIG. 2.

FIG. 4 is a view similar to FIG. 1 illustrating a modified form of the closure cap.

FIG. 5 is a view similar to FIG. 2 illustrating the modification of FIG. 4.

DESCRIPTION OF THE PREFERRED EMBODIMENTS

FIG. 1 illustrates, in section, the neck portion 10 of a bottle. The neck defines the throat opening 12 and may have an outer peripheral surface 13 having threads 14 formed therein adjacent the axial ring end 15 of the neck.

The neck portion shown can, for example, be a standard glass or plastic carbonated beverage container.

According to this invention the bottle neck is closed by a closure or cap 20. The cap is preferably formed of a resilient plastic. The cap is formed with an outer peripheral skirt portion 30 adapted to be received around the bottle neck. The skirt portion may have internal threadings 31 for engagement with the threads 14 of the bottle. The skirt portion 30 may have a reduced diameter ledge 32 adjacent its upper axial end 33.

The skirt portion merges into the axial end wall 40 of the cap at the corner area 33. Radially inwardly from the corner area 33 the axial end wall 40 includes a first annular flat land 41, an annular convoluted portion 42 and a central land 43.

The central land 43 is cup shaped having a hollow interior as at 44 defined between a top portion 45 and a peripheral wall forming a side leg 46.

As illustrated, in a preferred embodiment, the leg 46 may be substantially thicker than the U-shaped cross section convoluted portion 42. The convoluted portion 42 includes spaced radially inner and radially outer legs 50 and 51.

Due to the relative thinness of the material of the convoluted portion and the yieldability of the plastic, the U-shaped cross section convoluted portion has the ability to refold itself so that the location of the bight portion can change in a roller progressive change shortening one leg while elongating the other leg.

As shown in FIG. 1, the normal unstressed position of the convoluted portion is such that the radially outer leg 51 is about equal in size or slightly shorter than the radially inner leg 50. The radially inner leg 50 merges with the side wall or peripheral leg 46 such that the central land is elevated above the annular flat land 41.

In this position the cap may be threaded onto the neck until the top 15 of the neck engages the underside of the annular flat land 41. In this position the central land 43 will project significantly above the top of the flat land 41. However, upon depressing the central land, the convolution will roll the bight portion changing the effective length of the legs until the position of FIG. 2 is assumed. In this position, substantially all of the material of the convoluted portion will now form the radially outermost leg 51 and the top of the central land will be substantially coplaner with the top of the annular flat land 41 with the central land 43 at the axial end separated from the annular flat land 41 by a circumferential groove 50, the bottom of which is the bight 51 of the convoluted portion.

The diameter of the convoluted portion from the radially outermost leg 51 is dimensioned with respect to the standard neck size of the appropriately sized bottle such that the convoluted portion will engage the inside peripheral wall 60 of the throat opening.

It is preferred that the fit be dimensioned such that with the central land depressed, the cap cannot be fully threaded onto the neck of the bottle without forcing the central land to its raised position.

As illustrated in FIG. 1, a seal lip 70 may be formed at the bottom of the bight in the central land elevated position. Upon depressing, the lip will flex outwardly to engage the peripheral wall 60 of the throat providing a seal. Additionally, a second seal lip or bead 71 may be molded around the circumference of the leg 51 closer to the top of the leg.

It has been found that in depressing the central portion, one effect is to cause a circumferential spreading of the convoluted portion adjacent its bottom to cause a firm engagement of the wall 60 to occur. Because of this, and due to the yieldability of the plastic, any excessive pressure in the bottle will be retained by causing the legs to further tightly engage the wall 60.

However, by dimensioning the convoluted portion properly, taking into consideration any tendency of the convoluted portion to undergo any circumferential expansion upon depressing the central land, it can be assured that the maximum outer diameter of the convoluted portion with the central land depressed will, unless confined within the throat opening of a bottle, be large enough so that the cap cannot be fully threaded onto the bottle conveniently. In such a circumstance, forced threading of the cap onto the bottle will cause the central land to be raised to the position illustrated in FIG. 1. A raised central land is an adequate indication that the bottle has been tampered with so that visual inspection of the bottle from the outside will determine whether it has been opened subsequent to its manufacture, the central land being depressed during normal manufacturing assembly of the cap to the bottle.

In the embodiment illustrated in FIGS. 1 through 3, the lip 7, originally formed at the bottom of the bight, will expand outwardly circumferentially at its tip while at the same time undergoing a rotational movement so that it extends towards the wall 60 and into engagement with the wall 60. Further depressing of the central portion, if the dimension of the legs is such as to allow for the depressing after engagement of the lip, will cause a portion of the bight to reform below the lip seal 70.

Furthermore, as shown in FIG. 4, the lip seal 70 can, if desired, be formed on the radially innermost leg 50 spaced from the bight so that upon a rolling change of the location of the bight with respect to the material of the side legs 50 and 51, the lip seal will be moved downwardly and then around the bight into engagement with the side wall. Of course, if desired, more than the illustrated two circumferential seals may be provided.

In the embodiment of FIGS. 4 and 5, I have provided a hinge section 80 intermediate the annular flat land 41 and the top 81 of the radially outermost leg 51. A hinge may be formed by a material thickness reduction as at 85 at the connection of the portion 80 with the annular flat land 41. Preferably, the juncture at 81 is at a sharp angle such that the portion 80 extends upwardly from the annular flat land substantially with an outer frustoconical surface. Upon depression of the central land 43 the portion 80 will bend around the hinge 85 and the angle portion 81 will be brought into proximity with or engage the central land 43 to close the groove or gap 50 providing a flat continuous circular top for the cap. In order to encourage this, a bend point at 90 may be provided within the leg 51.

It can therefore be seen from the above that this invention provides an improved plastic closure cap having an axially center portion of the axial end face of the cup shaped cap dimensioned as a separate cup shaped portion which is movable axially with respect to the remainder of the cap from an elevated position to a position substantially coplaner with the remaining portions of the axial end face of the cap. A U-shaped cross section convoluted portion of flexible plastic interconnects the central portion with the radially more outer portions of the axial end wall of the cap. The radially outermost leg of the convoluted portion is adapted to engage the inside peripheral wall of the throat opening of a bottle neck and to be urged thereagainst tightly when the cap central land is depressed. The dimensioning is such that with the central portion depressed, the cap will not be easily attachable to the bottle neck and a resultant attachment attempt will cause the central land to become raised with respect to the remaining portions of the axial end wall of the cap thus signifying that the bottle has been tampered with.

Depression of the central land will cause a strong seal to occur between the radially outermost leg of the convoluted portion and the inside peripheral wall of the throat opening thereby assuring the maintenance of a liquid tight seal. The thickness of the material chosen can be such, with regard to its yieldability, that additional pressures within the container will cause a further circumferential expansion of the convoluted area to further tighten the seal.

Seal beads and circumferentially engageable lip seal portions can be formed on the convoluted portion.

Although the teachings of my invention have herein been discussed with reference to specific theories and embodiments, it is to be understood that these are by way of illustration only and that others may wish to utilize my invention in different designs or applications.

I claim as my invention:

1. A molded plastic bottle cap and bottle neck combination comprising a cap having an outer peripheral axially extending skirt, an axial end wall at one end of the skirt, the axial end wall having a radially outer portion and a radially inner portion, the radially inner portion being connected to the radially outer portion through a convolution band being convoluted in the direction of the extension of the skirt from the axial end wall, the radially inner portion being movable from a first position projecting above the radially outer portion to a second position substantially coplaner with an axial outer face opposite the projection of the skirt of the radially outer portion, the convolution band being formed of yieldable material, a bottle neck adapted to receive the cap, said cap having a first stable position at the second position when fully attached to said bottle neck and seated thereon after forced movement from the first position to the second position subsequent to attachment to the bottle neck and a second stable position at the first position when attached to said bottle neck and seated thereon prior to said forced movement.

2. The device of claim 1 wherein the convolution band has an outer diameter prior to attachment to the bottle neck greater than an inner diameter of the bottle neck whereby attachment of the cap to the bottle neck will cause the radially inner portion to assume the first position.

3. A device of claim 2 including lip seal means formed on the convoluted band interior of the bottle cap, the lip seal means being substantially out of contact with the inner diameter of the throat opening of the bottle neck when the radially inner axial end portion is in the first position and being in circumferential seal contact with the inner diameter surface of the bottle neck adjacent the throat opening when the radially inner portion is in the second position.

4. A device of claim 3 wherein the convolution band includes a radially inward leg and a radially outer leg, the radially outer leg being provided with circumferential seal means projecting radially outwardly therefrom.

5. A plastic molded bottle cap and bottle neck combination comprising a bottle neck, a cap adapted to be received on the bottle neck having an annular axially extending outer peripheral skirt, an axial end wall at one axial end of the skirt, the axial end wall having a radially outermost portion and a radially central portion interconnected by a convoluted annular band of yieldable material, the radially central portion being movable from a first position extending above remaining portions of the cap to a second position spaced below the first position, the convoluted annular band providing a substantially axially extending leg intermediate the central portion and the skirt, the leg having an outer diameter when the central portion is in the second position greater than the inner diameter of a bottle neck adjacent the throat opening of the bottle neck whereby an attempt to cap the bottle with the central portion in the second position will cause interference between the throat opening of the bottle neck and the leg of the convoluted band and cause movement from the second position to the first position, said cap having a stable position at the second position when fully seated on the bottle neck after forced movement from the first position to the second position and having a second stable position at the first position when fully seated on the bottle neck.

6. The device of claim 5 wherein the convolution band has a circular groove opening at a top of the cap between the radially outermost portion and the radially central portion, a pivotable annular portion interconnecting a radially outermost leg of the convoluted band with the radially outermost portion, the annular portion effective to close the circular groove at the axial end wall when the central portion is in the second position.

* * * * *